United States Patent [19]

Williams

[11] Patent Number: 4,512,603

[45] Date of Patent: Apr. 23, 1985

[54] BOOK SUPPORT SYSTEM

[76] Inventor: Tommy A. Williams, 12902 N. Point La., Laurel, Md. 20708

[21] Appl. No.: 462,904

[22] Filed: Feb. 1, 1983

[51] Int. Cl.[3] ..... A47B 23/00

[52] U.S. Cl. ..... 294/137; 248/451; 294/148

[58] Field of Search ..... 294/137, 138, 141, 142, 294/144, 148, 149, 151, 165, 166; 248/441 R, 441 A, 444, 450, 451–454, 458–460; 281/33, 45, 46

[56] References Cited

U.S. PATENT DOCUMENTS

| | | | |
|---|---|---|---|
| 340,839 | 4/1886 | Ward | 248/451 |
| 1,263,761 | 4/1918 | Haslam | 248/453 |
| 1,376,212 | 4/1921 | Mayhew | 248/451 |
| 1,666,803 | 4/1928 | Walker | 248/454 |
| 2,807,908 | 10/1957 | Lykes | 248/451 |
| 3,065,565 | 11/1962 | Goodman | 248/460 X |
| 3,339,875 | 9/1967 | Gerald | 248/452 X |

FOREIGN PATENT DOCUMENTS

| | | | |
|---|---|---|---|
| 208814 | 4/1960 | Austria | 248/451 |
| 112213 | 3/1945 | Sweden | 248/451 |

*Primary Examiner*—Johnny D. Cherry
*Attorney, Agent, or Firm*—Morton J. Rosenberg

[57] ABSTRACT

A book support system (10) is provided to allow manual holding and reading of book (12) in one hand of a user. The book support system (10) includes a housing (18) having a recess (20) formed therein. The recess (20) is of predetermined contour and is adapted for insert and receipt of the book (12). A releasable constrainment mechanism (56) including orthogonally directed first and second resilient members (58 and 60) are included to constrain the book (12) within the recess (20). The releasable constrainment mechanism (56) is secured to the housing (18) and a tab member (48) is provided in a lower section of the housing (18) to allow the user to hold the book support system (10) in one hand while reading.

16 Claims, 4 Drawing Figures

BOOK SUPPORT SYSTEM

BACKGROUND OF THE INVENTION

1. Field of the Invention

This invention relates to a book support system for releasably constraining a book contained therein. In particular, this invention pertains to a book support system which allows a book to be constrained therein while permitting the user to hold the overall book support system in one hand. More in particular, this invention relates to a book support system which maintains the book in an open position at a predetermined location. Still further, this invention relates to a book support system including a housing having a recess formed therein within which the book is inserted and constrained from removal therefrom. More in particular, this invention directs itself to a book support system having a housing with a tab or hand hold element secured on a bottom portion thereof to allow the user to hold the book support system with a single hand. Further, this invention relates to a book support system where a book is maintained within a recess of a housing by a releasable constrainment mechanism which may be deformed to allow insert or removal of the book at the discretion of the user. Still further, this invention pertains to a book support system having a housing where a releasable constrainment mechanism for the book contained therein is provided by a first and second resilient cord member passing in orthogonal direction across the face of a recess formed in the housing.

Prior Art

Book support or holding systems are well-known in the art. The closest prior art known to Applicant includes U.S. Pat. Nos. 3,951,374; 3,747,889; 3,097,444; 4,014,508; 1,116,016; 1,923,351; 4,116,414; 2,224,530; 3,833,197; 2,807,908; 4,296,946; 889,863; 634,922; 1,246,243; 3,447,770; 3,227,415; 2,792,668; 2,528,695; and, 3,986,232.

In some prior art systems such as that shown by U.S. Pat. No. 3,951,374, there are provided book holders having partial recesses. In such prior art systems, vertically directed elastic cord members are shown to maintain the book against a wall of the book holder. However, such systems do not provide for the orthogonally directed elastomeric cords which give maximum support to the book and maintain such in a restricted position during displacement of the book holder. Additionally, such prior art references do not provide for a full recess type of insert for the book which additionally supports the book in a predetermined manner within the book holder.

In other prior art systems such as that shown in U.S. Pat. No. 3,747,889, there are provided flexible bands to hold the pages of a book. However, such diagonally directed bands do not provide for the constrainment support necessary to maintain the book in a secure generally immobile position. Additionally, such references do not provide for the added important feature of a recess within which the book is inserted for support thereof during operation.

In other prior art systems such as that shown in U.S. Pat. No. 3,097,444, such provides for horizontally directed rubber bands to maintain the book against a generally planar wall section. However, such wall sections do not provide for the recess within which the book may be maintained and constrained.

In other prior art references such as that shown in U.S. Pat. No. 4,014,508, there are provided book holding devices to hold the book against a generally planar surface. A cylindrically shaped member passes across the pages of the book and hold the book against the surface or backboard of the holding devices. This does not provide for the structural integrity of having a pair of flexible cord members mounted substantially orthogonal each to the other and further does not provide for the added support of the book within a recess of a housing.

In other prior art references, such as that shown in U.S. Pat. No. 4,116,414, there are provided other types of book holding devices which do not provide for elastic members, but do provide for other types of pinching elements. Additionally, in many of such prior art devices, there is no handhold element to allow grasping of the overall book support system in one hand of a user.

SUMMARY OF THE INVENTION

A book support system which includes a housing having a recess formed therein. The recess has a predetermined contour adapted for receipt of a book with the housing extending in a transverse direction. There is also provided a mechanism for releasably constraining the book within the recess with the releasable constrainment mechanism being coupled to the housing.

DESCRIPTION OF THE PREFERRED EMBODIMENTS

Figure 1:
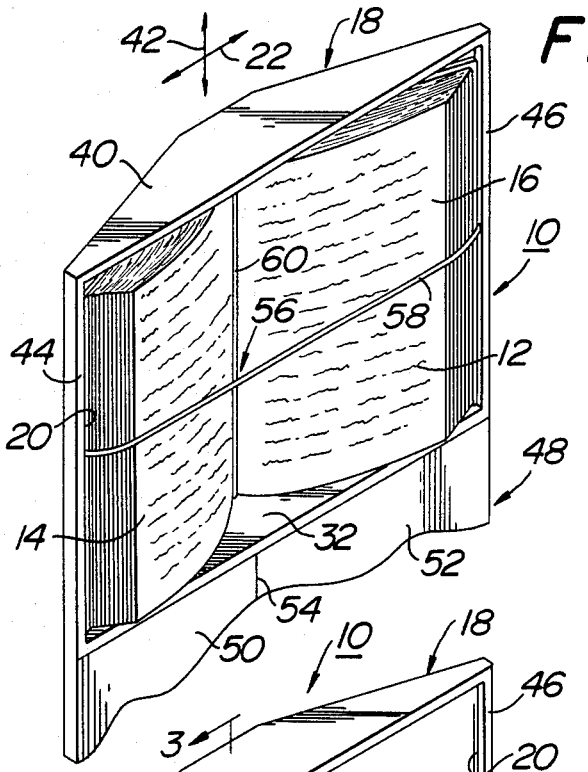
FIG. 1 is a perspective view of the book support system showing a book contained therein.

Referring now to FIGS. 1–4, there is shown book support system 10 for supporting and containing book 12 in a predetermined position. In overall concept, book support system 10 mounts book 12 in a relatively stationary position such that pages 14 and 16 may be read without the necessity of the user holding book 12 with both hands. In most types of book 12, the binding provides for a biasing rotational force to close book 12. Thus, the user generally holds book 12 with both hands to maintain book 12 in a relatively stationary position such that pages 14 and 16 may be read.

In overall concept, book support system 10 as will herein be described in following paragraphs, may be generally used for holding books 12, or other reading material while allowing simultaneously the user to maintain a free hand for other activities. Book support system 10 may be of particular use to persons who are handicapped or otherwise incapacitated, or in general, allows the holding and releasable constrainment of book 12 when the user does not have both hands available for support of book 12, or a variety of other reasons. Thus, book support system 10 as has hereinbefore been described, facilitates and aids in maintaining book 12 in an open position while minimizing restraints on the user.

Book support system 10 includes housing or support member 18 having recess 20 formed therein. Recess 20 has a predetermined contour generally in the geometrical shape of a rectangle or square, which is adapted for receipt of book 12. Housing or support member 18 extends in a transverse direction described by directional arrow 22.

Figure 2:
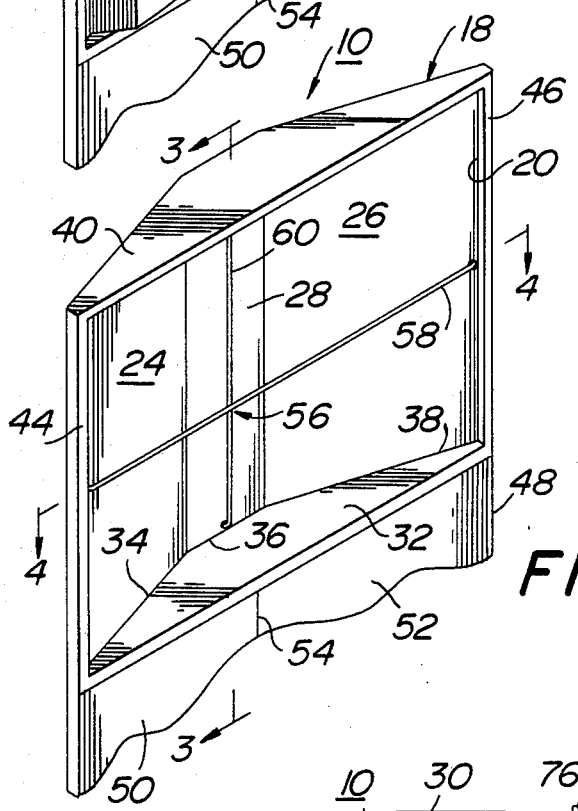
FIG. 2 is a perspective view of the book support system.
Figure 4:
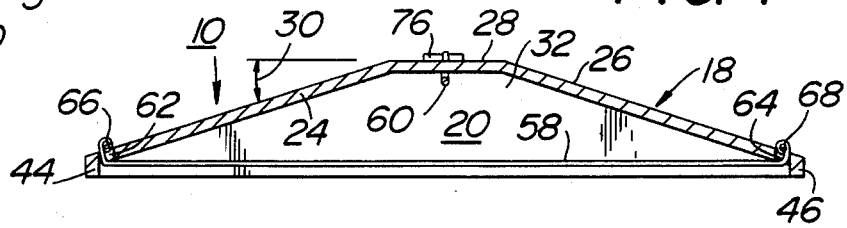

Recess 20 formed within housing or support member 18 defines frontal wall members 24 and 26, as is clearly seen in FIGS. 2 and 4. Frontal wall members 24 and 26 interface with and extend from binding wall member 28, which is generally positionally located substantially central the overall dimension taken in transverse direction 22 of housing 18. Binding wall member 28 is generally planar in contour and is adapted to receive the cover binding of book 12.

Frontal wall members 24 and 26 are clearly seen in FIG. 4 to be inclined with respect to transverse direction 22. Frontal wall members 24 and 26 are generally linearly inclined and provide for substantially planar wall member surfaces. Inclination angle 30 of frontal wall members 24 and 26 is generally not important to the inventive concept as herein described, but has been found to be advantageous within the angle range approximating 10°–30°. Both frontal wall member 24 and frontal wall member 26 are directed to the same inclination angle 30 as is shown in FIG. 4.

The concept of providing inclination angle 30 to define inclined frontal wall members 24 and 26 with respect to transverse direction 22 is to maximize the useful life of book 12. Generally, especially in hard bound books 12, the binding tends to maintain book 12 in a closed position. Thus, where book 12 is opened and maintained in a planar back surface condition, such has a tendency of destroying the adhesive elements which maintain book 12 in a useful condition. When the adhesive is destroyed, book 12 may lose its pages or otherwise deteriorate in operating conditions. Thus, by providing inclined frontal wall members 24 and 26, book 12 is not stretched to the point where the adhesive elements will begin to tear or otherwise be destroyed. This may have an important effect, since book 12 may be maintained within housing or support member 18 for prolonged periods of time.

Housing or support member 18 includes lower ledge member 32 as shown in FIGS. 1 and 2, extending in transverse direction 22. Lower ledge member 32 is secured to frontal wall members 26 and 24, as well as binding wall member 28 along wall interface boundaries 34, 36 and 38. Lower ledge member 32 defines a substantially planar surface to allow mounting of book 12, as is shown in FIG. 1. Additionally, frontal wall members 24 and 26 as well as binding wall member 28 are directed substantially normal to lower ledge member 32. In this manner, book 12 may be releasably supported within recess 20 of housing 18.

Housing 18 further includes upper ledge member 40 extending in transverse direction 22. Upper ledge member 40 is generally planar in contour and in cross-sectional plane taken with respect to longitudinal direction 42, forms a truncated triangular contour, much in the manner as that provided for lower ledge member 32. Upper ledge member 40 forms a portion of a peripheral boundary of recess 20 for insert of book 12. Additionally, upper ledge member 40 is secured to frontal wall members 24 and 26 as well as binding wall member 28 in a direction normal to walls 24, 26 and 28. Housing 18 further provides for a pair of transversely displaced sidewall members 44 and 46 secured to upper and lower ledge members 40 and 32, respectively.

Thus, transversely displaced sidewall members 44 and 46 in combination with ledge members 40 and 32 define the overall peripheral boundary for recess 20 of housing 18. The contour as has previously been described may be defined in a rectangular geometrical contour or square contour adaptable to a wide variety of books 12.

Ledge members 32 and 40 as well as sidewall members 44 and 46 may be secured to walls 24, 26 and 28 by adhesive mounting, bolting, or some like technique. However, it is to be clearly understood that housing 18 including ledge members 32 and 40, as well as sidewall members 44 and 46, may be formed in one-piece formation with wall members 24, 26 and 28. Housing 18 may be formed of wood, plastic, or some like material, not important to the inventive concept as herein described.

Housing 18 of book support system 10 further includes tab member 48 secured to lower ledge member 32 and wall members 24, 26 and 28. Tab member 48 provides for first and second tab wall members 50 and 52 inclined with respect each to the other in generally the same inclination angle 30 as previously described for frontal wall members 24 and 26. Tab first and second walls 50 and 52 are inclined with respect to each other, and interface along central interface 54 as shown in FIGS. 1 and 2. Tab member 48 extends downwardly in longitudinal direction 42 from lower ledge member 32 to provide a manual hold for housing 18. Thus, a user may easily grasp walls 50 and 52 in one hand and gain visual access to book 12 within housing 18.

Referring now to FIGS. 1–4, book support system 10 further includes releasable constrainment mechanism 56 for releasably maintaining and supporting book 12 within recess 20. As can be clearly understood, book 12 may have a tendency of tilting forward or otherwise being removed from internal recess 20 during movement by the user. As will be seen in following paragraphs, releasable constrainment mechanism 56 provides for a constrainment set of elements which maintain book 12 within recess 20 under a wide variety of locational positions of housing 18.

Releasable constrainment mechanism 56 includes first resilient member 58 extending in transverse direction 22. First resilient member 58 is secured to housing 18 on opposing transverse ends thereof.

First resilient member 58 is positionally located substantially at the center of the longitudinal extension of recess 20. First resilient member 58 may be formed of an elastic cord which is reversibly resilient in nature to provide a resilient barrier in the event that book 12 is tilted in a forward direction when mounted within recess 20.

Figure 3:
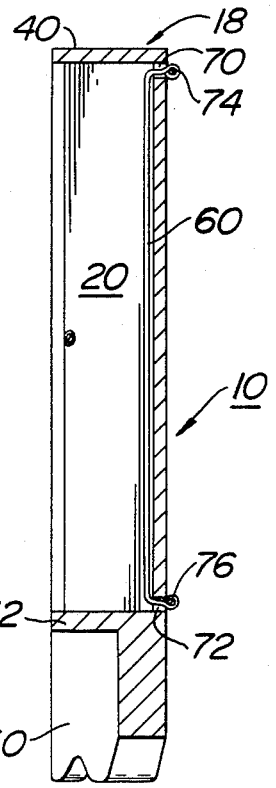
FIG. 3 is a sectional view of the book support system taken along the section lines 3—3 of FIG. 2; and, FIG. 4 is a sectional view of the book support system taken along the section lines 4—4 of FIG. 2.

First resilient member or elastic cord 58 passes at least partially through housing 18 on opposing transverse ends thereof. Elastic cord 58 is shown in FIG. 4 to pass through opposing openings 62 and 64 formed through wall members 24 and 26, respectively. Elastic cord member 58 is mounted or coupled to rear surfaces of walls 24 and 26 by passage of rod members 66 and 68 having an extension substantially greater than the diameter of openings 62 and 64. Thus, first resilient member 58 may be knotted on opposing transverse ends thereof and tied to first and second rod members 66 and 68. Rod members 66 and 68 having an extended length greater than a diameter of a respective opening 62 and 64, couple first resilient member 58 to the rear surface of both walls 24 and 26. Referring now to FIGS. 1, 2 and 3, it is seen that releasable constrainment mechanism 56 includes second resilient member 60 passing in longitudinal direction 42 substantially bisecting the transverse dimension of recess 20. Second resilient member 60 may also be formed of an elastic cord construction having a resilient nature much in the manner that first resilient member 58 has been described.

Thus, second resilient member 60 or second elastic cord member extends in longitudinal direction 42 normal transverse direction 22. Second resilient member 60 is coupled to housing 18 on opposing longitudinal ends thereof. Elastic cord member 60 passes through longitudinally displaced openings 70 and 72, as is seen in FIG. 3. Openings 70 and 72 have a predetermined diameter which interact with rod member 74 and 76, each having an extended length greater than the opening diameters. As in the case for first resilient member 58, second resilient member 60 may be knotted or otherwise secured to rod members 74 and 76 to mount second resilient member 60 to housing 18.

In operation, book 12 may be inserted into book support system 10 by initially extending both first and second resilient members 58 and 60 away from walls 24, 26 and 28. Book 12 is then opened and inserted under first and second resilient members 58 and 60. Resilient members 58 and 60 are then released and resiliently constrain book 12 within recess 20 of housing or support member 18. Book 12 may be read by manually grasping tab member 48 in one hand by the user.

As has hereinbefore been described, book support system 10 may be formed of a number of materials such as plastic, wood, or metal, and may be coupled each to the other in various individual part sections, or formed in one-piece formation by molding, or other like techniques.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or the scope of the invention as defined in the appended claims.

What is claimed is:

1. A book support system comprising:

(a) a housing having a recess formed therein, said recess having a predetermined contour adapted for receipt of a book, said housing being extended in a transverse direction;

(b) means for releaseably constraining said book within said recess, said releaseable constraining means being coupled to said housing; and, (c) a transversely extending tab member secured to said housing, said tab member defining a continuous tab wall member extending throughout the entire transverse dimension of said housing for providing a manual hold for said housing along said transverse dimension, said housing defining a pair of frontal members and a pair of upper and lower ledge members secured to said frontal members for forming a peripheral boundary of said recess.

2. The book support system as recited in claim 1 where said means for releasably constraining said book includes a first resilient member extending in said transverse direction, said first resilient member being secured to said housing on opposing transverse ends thereof.

3. The book support system as recited in claim 2 where said first resilient member passes at least partially through said housing on opposing transverse ends thereof.

4. The book support system as recited in claim 3 where said first resilient member is coupled to a rear wall surface of said housing on said opposing transverse ends thereof.

5. The book support system as recited in claim 3 where said first resilient member is a first elastic cord member.

6. The book support system as recited in claim 5 where said means for releasably constraining said book includes a second resilient member extending in a longitudinal direction substantially normal said transverse direction, said second resilient member being coupled to said housing on opposing longitudinal ends thereof.

7. The book support system as recited in claim 6 where said second resilient member passes at least partially through said housing on opposing longitudinal ends thereof.

8. The book support system as recited in claim 7 where said second resilient member is coupled to a rear wall surface of said housing on said opposing longitudinal ends thereof.

9. The book support system as recited in claim 8 where said second resilient member is a second elastic cord member.

10. The book support system as recited in claim 1 where said frontal wall members are substantially linearly inclined with respect to said transverse direction.

11. The book support system as recited in claim 1 including an upper ledge member extending in said transverse direction, said upper ledge member forming a portion of a peripheral boundary of said recess, said upper ledge member being secured to said frontal wall members.

12. A book support system comprising:

(a) a support member for supporting a book, said support member including a recess of predetermined contour adapted for insert of said book therein, said support member defining a lower ledge member for support of said book;

(b) means for releaseably constraining said book within said recess formed within said support member; and, (c) a tab member extending in a transverse direction and secured to said support member, said tab member defining a continuous transversely directed tab wall member for providing a manual hold for said support member, said tab wall member extending substantially throughout an entire transverse dimension of said support ember below said lower ledge member.

13. The book support system as recited in claim 12 where said support member includes:

(a) a wall member defining at least one surface for interfacing with said book;

(b) a lower ledge member extending in a transverse direction and secured to said wall member;

(c) an upper ledge member extending in said transverse direction and secured to said wall member; and, (d) a pair of transversely displaced sidewall members secured to said wall member, said lower ledge member, said upper ledge member and said sidewall members defining said recess predetermined contour.

14. The book support system as recited in claim 13 where said wall member includes a pair of inclined surfaces, said surfaces being inclined with respect to said transverse direction.

15. The book support system as recited in claim 14 where said wall member defines a truncated triangular cross-sectional contour in a direction substantially coincident said transverse direction.

16. The book support system as recited in claim 12 where said support member is formed in one piece formation.

* * * * *